US009160090B2

(12) United States Patent
Su et al.

(10) Patent No.: US 9,160,090 B2
(45) Date of Patent: Oct. 13, 2015

(54) ELECTRICAL CONNECTOR MODULE

(71) Applicants: NEXTRONICS ENGINEERING CORP., New Taipei (TW); YAMAICHI ELICTRONICS CO., LTD., Tokyo (JP)

(72) Inventors: Hou-An Su, Keelung (TW); Hai-Wen Yang, Baoji (CN); Xuan Luo, Zhijiang (CN); Hai-Yang Xiao, Yizhang County, Hunan Province (CN); Toshiyasu Ito, Chiba-ken (JP); Masaaki Saito, Tokyo (JP)

(73) Assignees: NEXTRONICS ENGINEERING CORP., New Taipei (TW); YAMAICHI ELICTRONICS CO., LTD., Tokyo (JP)

( * ) Notice: Subject to any disclaimer, the term of this patent is extended or adjusted under 35 U.S.C. 154(b) by 0 days.

(21) Appl. No.: 14/067,018

(22) Filed: Oct. 30, 2013

(65) Prior Publication Data

US 2014/0302713 A1 Oct. 9, 2014

(30) Foreign Application Priority Data

Apr. 3, 2013 (CN) ..... 2013 2 0165162 U

(51) Int. Cl.

| | |
|---|---|
| ***H01R 13/648*** | (2006.01) |
| ***H01R 12/70*** | (2011.01) |
| ***H01R 13/627*** | (2006.01) |
| ***H01R 13/6594*** | (2011.01) |
| ***H01R 25/00*** | (2006.01) |

(52) U.S. Cl.

CPC ..... *H01R 12/7082* (2013.01); *H01R 13/6275* (2013.01); *H01R 13/6594* (2013.01); *H01R 25/00* (2013.01)

(58) Field of Classification Search

CPC ..... H01R 13/6658; H01R 13/518; H01R 23/7073; H01R 13/65802; H01R 23/6873; H01R 23/025; H01L 23/4006; H01L 23/4093; H05K 9/0058

USPC ..... 439/76.1, 485, 540.1, 541.5, 607.2, 439/607.21, 607.35, 676; 361/704, 715

See application file for complete search history.

(56) References Cited

U.S. PATENT DOCUMENTS

| | | | | |
|---|---|---|---|---|
| 5,241,453 | A * | 8/1993 | Bright et al. | 361/704 |
| 6,558,191 | B2 * | 5/2003 | Bright et al. | 439/541.5 |
| 6,752,663 | B2 * | 6/2004 | Bright et al. | 439/607.25 |
| 7,438,596 | B2 * | 10/2008 | Phillips | 439/607.01 |
| 7,463,495 | B2 * | 12/2008 | Tanaka et al. | 361/807 |
| 7,529,094 | B2 * | 5/2009 | Miller | 361/715 |
| 7,539,018 | B2 * | 5/2009 | Murr et al. | 361/704 |
| 7,583,510 | B2 * | 9/2009 | Wang | 361/753 |

(Continued)

*Primary Examiner* — Thanh Tam Le

(74) *Attorney, Agent, or Firm* — Li & Cai Intellectual Property (USA) Office

(57) ABSTRACT

An electrical connector module for electrically connecting at least one connector to a printed circuit board of an electronic device includes at least one shielding jack having a top wall, two opposite side walls and at least one common wall. The walls of the shielding jack collectively define at least a slot therewithin for receiving the connectors and a front end and an opposite rear end. The slot is divided by the common wall. The side walls and the common wall have a plurality of press fit terminals extending toward the circuit board. The common wall has a plurality of offset latch arms engaged with different connectors. When the connectors are inserted to the slots, the offset latch arms respectively secure the connectors in the corresponding slots.

15 Claims, 12 Drawing Sheets

(56) References Cited

U.S. PATENT DOCUMENTS 7,869,224 B1 * 1/2011 Yang ..... 361/800
8,053,667 B2 * 11/2011 Chen et al. ..... 174/50
8,599,559 B1 * 12/2013 Morrison et al. ..... 361/702
8,613,632 B1 * 12/2013 Nichols ..... 439/607.21
8,911,256 B2 * 12/2014 Qiao et al. ..... 439/607.18
2006/0040556 A1 2/2006 Neer et al.

* cited by examiner

ELECTRICAL CONNECTOR MODULE

BACKGROUND

1. Field of the Invention

The instant disclosure relates to an electrical connector module; in particular, to an electrical connector module for receiving and transmitting high speed signal in an electronic device.

2. Description of Related Art

Small form-factor pluggable (SFP) connector, XFP connector and QSFP connector are used in optical fiber transmission or signal transmission. The SFP connector acts as a bridge for mutual communication between the power cable and the optic fiber. The SFP connector is typically implemented in telecommunication and printed circuit board and the like. Different industrial standards define different connector types between the computer and transceiver modules, for example, modem, Internet interface. Gigabit Interface Converter (GBIC) is a common transceiver module between a computer and Ethernet, optic fiber channel or the like.

When the SFP connector is used along with compact electronic device, the connector guiding and fastening are relatively more challenging. The conventional SFP connector may not be easily inserted to its receptacle especially under blind mating. For example, an US application, application number 20060040556A1, disclosed a SFP connector enclosed by a metal shield. The metal shield defines an opening for receiving opposing connector. One or more than one guiding tabs are formed and extending from the opening to the hollow interior. The guiding tabs serve to lead the opposing connector in a correct alignment. However, the opposing connector also requires corresponding grooves in order to mate the guiding tabs. The guiding tabs may be formed at different positions and the corresponding grooves have to be relocated as well. The manufacturing process of the above-mentioned SFP connector and the opposing connector is more complicated therefore incurring higher cost. Additionally, choosing to use the specific SPF connectors and its conforming connector is inconvenient. The same issue exists in QSFP connectors and XFP connectors.

To address the above issues, the inventor strives via associated experience and research to present the instant disclosure, which can effectively improve the limitation described above.

SUMMARY OF THE INVENTION

The instant disclosure provides an electrical connector module having a plurality of offset latch arms for securing a plurality of connectors on different sides of a common wall.

The electrical connector module for electrically connecting at least one connector to a printed circuit board of an electronic device includes at least one shielding jack. The shielding jack includes a top wall, two opposite side walls and at least one common wall. The walls of the shielding jack collectively define at least a slot therewithin for receiving the connectors and a front end and an opposite rear end. The slot is divided by the common wall. The side walls and the common wall have a plurality of press fit terminals extending to the circuit board. The common wall has the plurality of offset latch arms engaged with different connectors. When the connectors are inserted to the slots, the offset latch arms respectively secure the connectors in the corresponding slots.

In short, the offset latch arms formed on the common wall maximize the locking area and satisfy multiple connectors being locked at different sides of the common wall.

In order to further understand the instant disclosure, the following embodiments are provided along with illustrations to facilitate the appreciation of the instant disclosure; however, the appended drawings are merely provided for reference and illustration, without any intention to be used for limiting the scope of the instant disclosure.

DETAILED DESCRIPTION OF THE PREFERRED EMBODIMENTS

The aforementioned illustrations and following detailed descriptions are exemplary for the purpose of further explaining the scope of the instant disclosure. Other objectives and advantages related to the instant disclosure will be illustrated in the subsequent descriptions and appended drawings.

The instant disclosure provides a connector module 100 especially applicable to high frequency CFP2/CFP4 optic fiber connector for transmission speed above 100 Gb/s. However, the instant disclosure is not limited to an embodiment and other types of electronic modules may also be in cooperation with the instant disclosure.

Figure 1A:
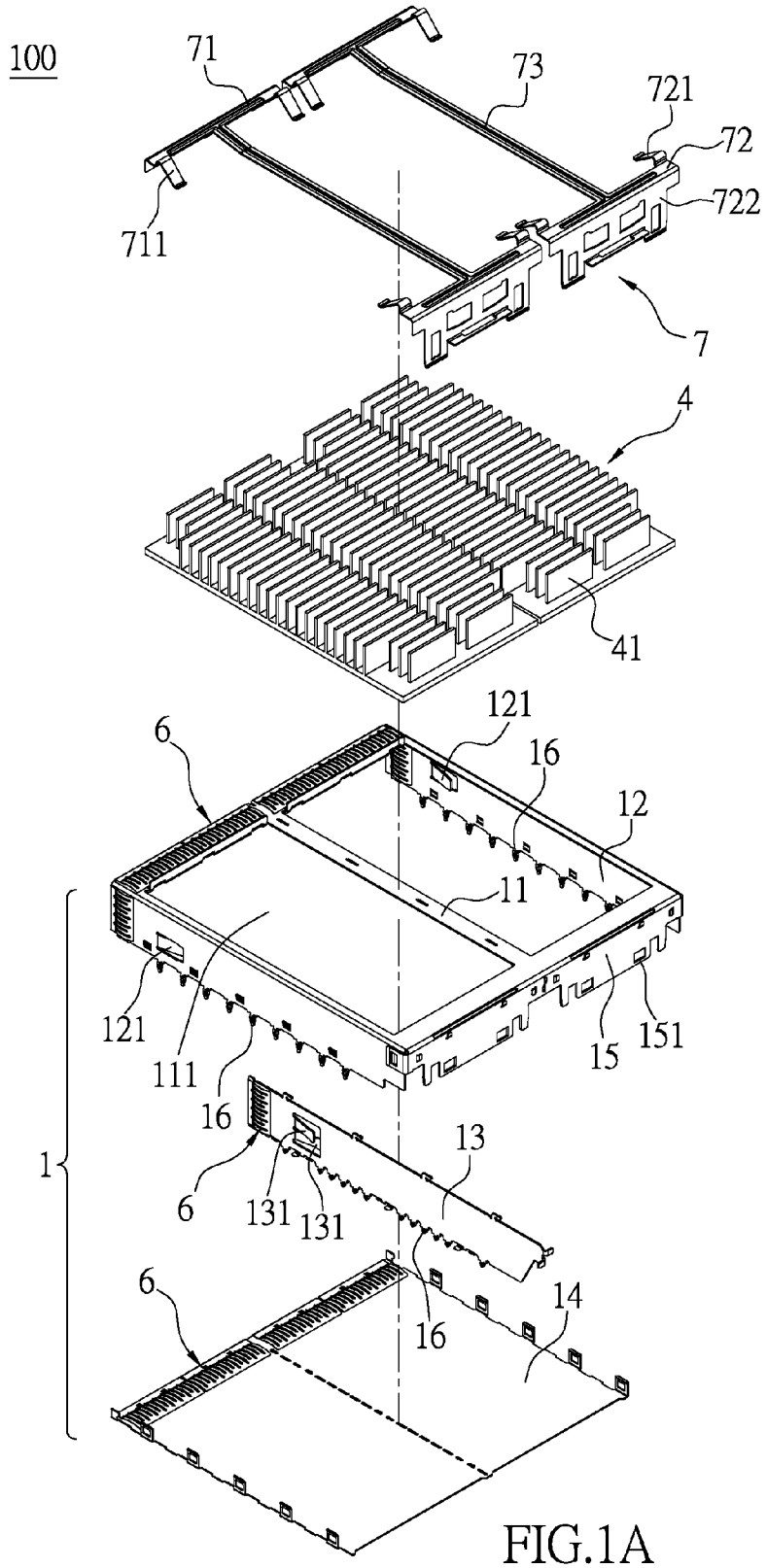
FIG. 1A is an exploded perspective view illustrating a shielding jack of a connector module in accordance with the instant disclosure.
Figure 1B:
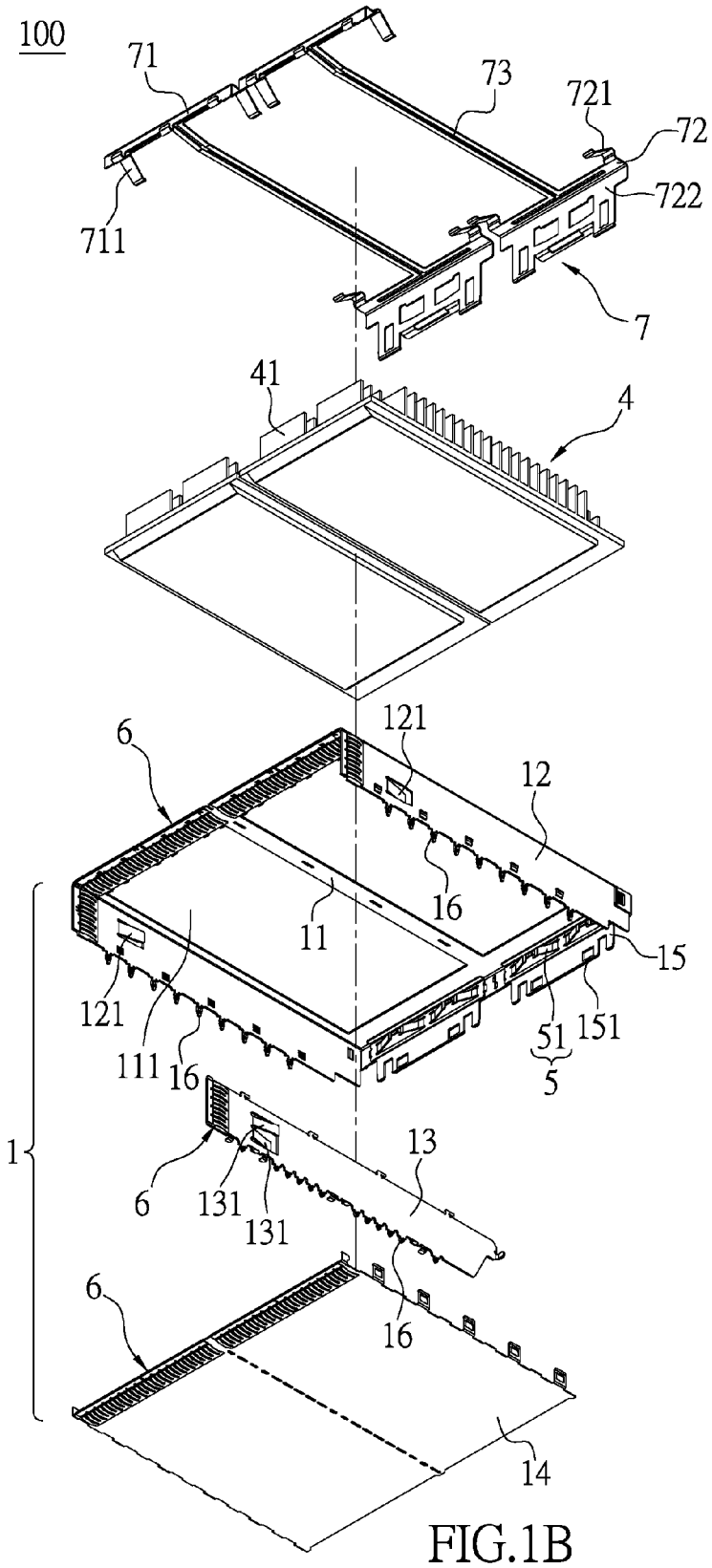
FIG. 1B is an exploded perspective view from a different viewing angle illustrating a shielding jack of a connector module in accordance with the instant disclosure.
Figure 2:
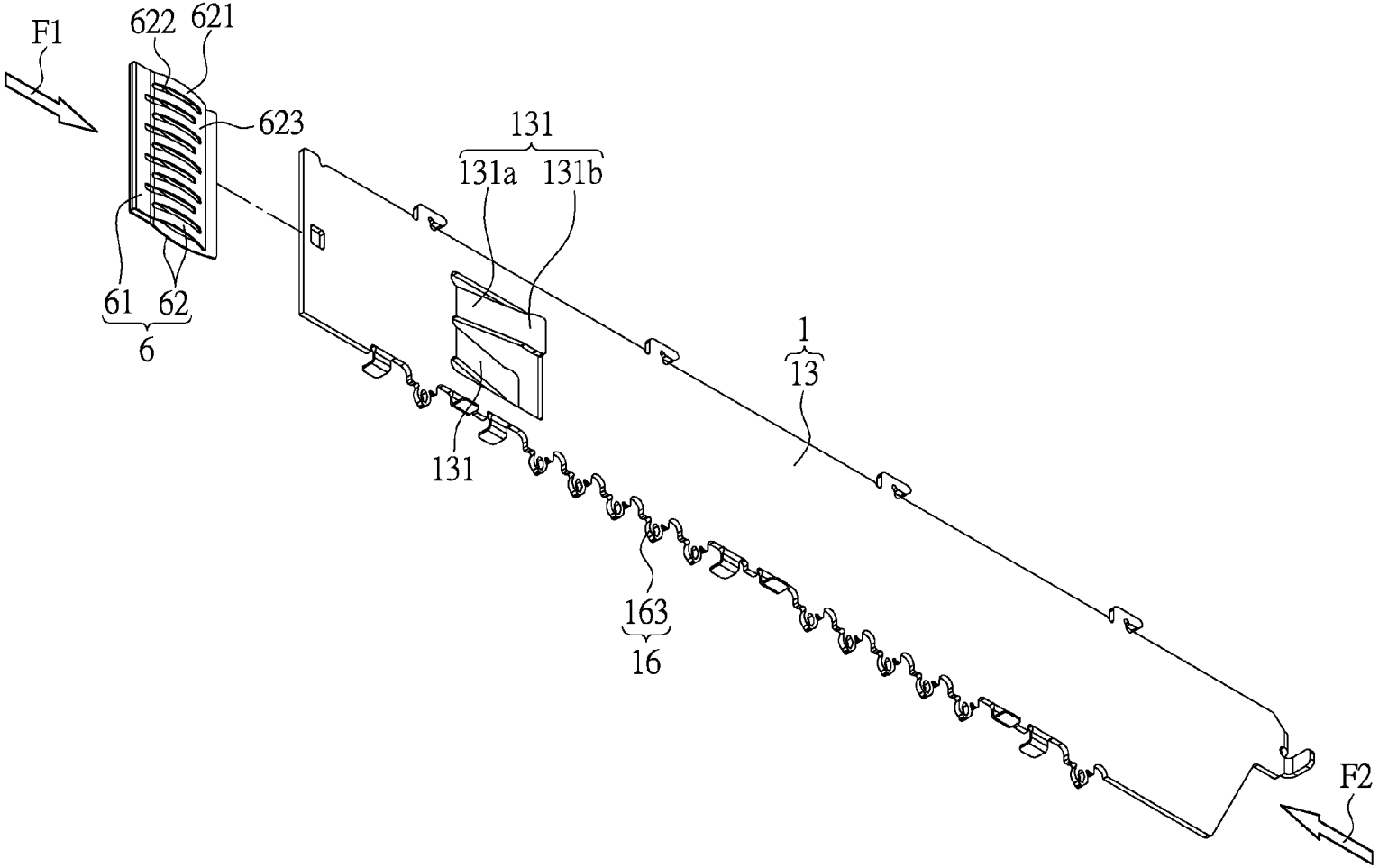
FIG. 2 is a perspective view illustrating a common wall of a connector module in accordance with the instant disclosure.
Figure 6:
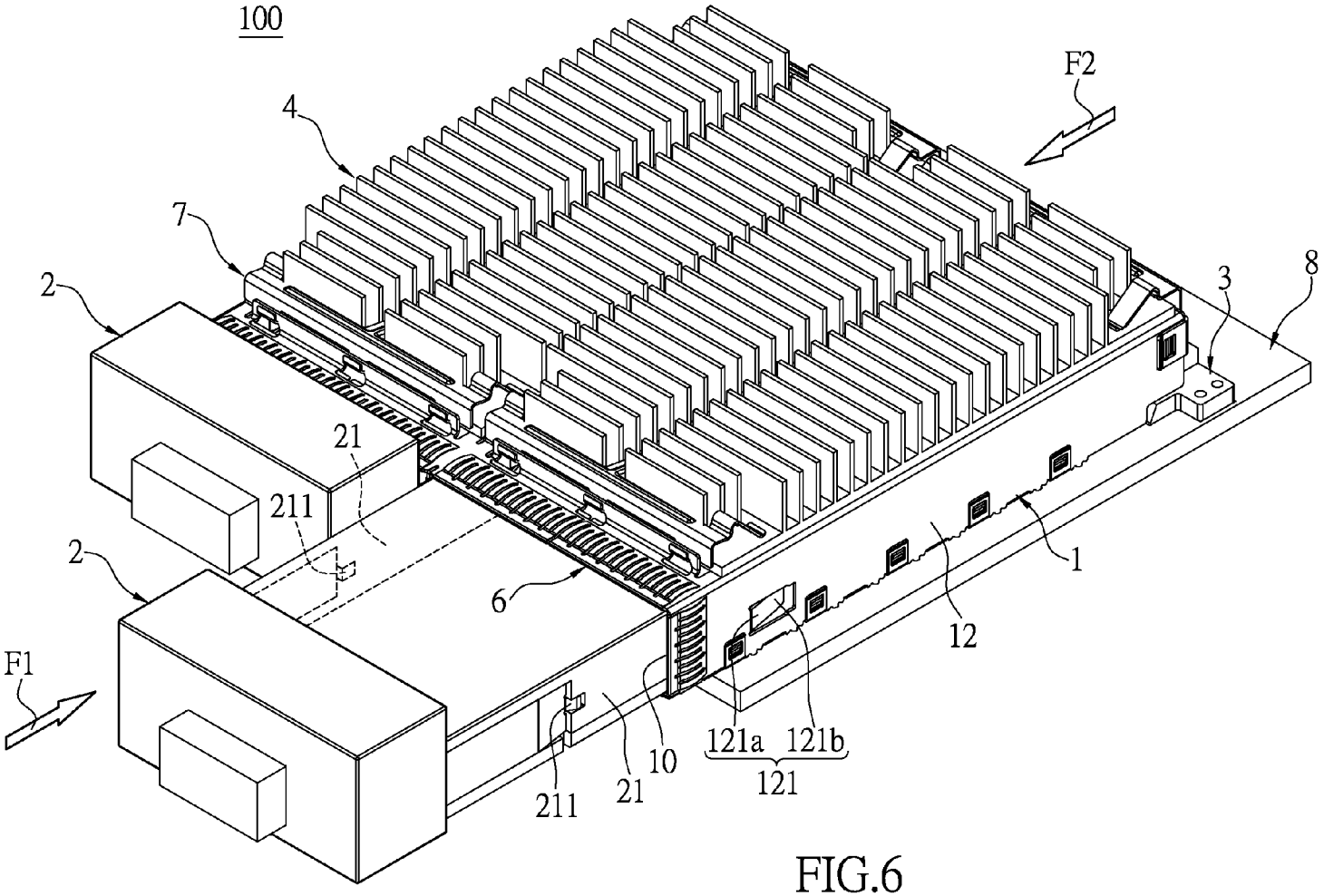
FIG. 6 is an operation view of a connector module in accordance with the instant disclosure.

Referring to FIGS. 1A to 3C, the connector module 100 receives a connector 2 (FIG. 6) and electrically connects the connector 2 to a printed circuit board 8 (FIG. 6) in an electronic device. As shown in FIGS. 1A, 1B and 3A, the connector module 100 includes at least one shielding jack 1. The shield jack 1 has a front end F1 and an opposite rear end F2. The shielding jack 1 defines at least one slot 10. The slot 10 is configured to receive the opposing connector 2 (FIG. 6) for signal transmission. The shielding jack 1 includes at least one top wall 11 and two opposite side walls 12. The slot 10 is divided longitudinally by a common wall 13. The side walls 12 and the common wall 13 have a plurality of press-fit terminals 16 which fits into the printed circuit board 8 (FIG. 6). As shown in FIG. 2, the common wall 13 of the shielding jack 1 has a plurality of offset latch arms 131. Each latch arm 131 corresponds to a different connector 2. When the connectors 2 are inserted to their corresponding slots 10, the offset latch arms 131 individually secure the connectors 2 in the slots 10. In other words, the common wall 13 of the shielding jack 1 is capable to simultaneously and firmly secure more than one connectors 2 in the different compartments of the shielding jack 1.

Figure 3A:
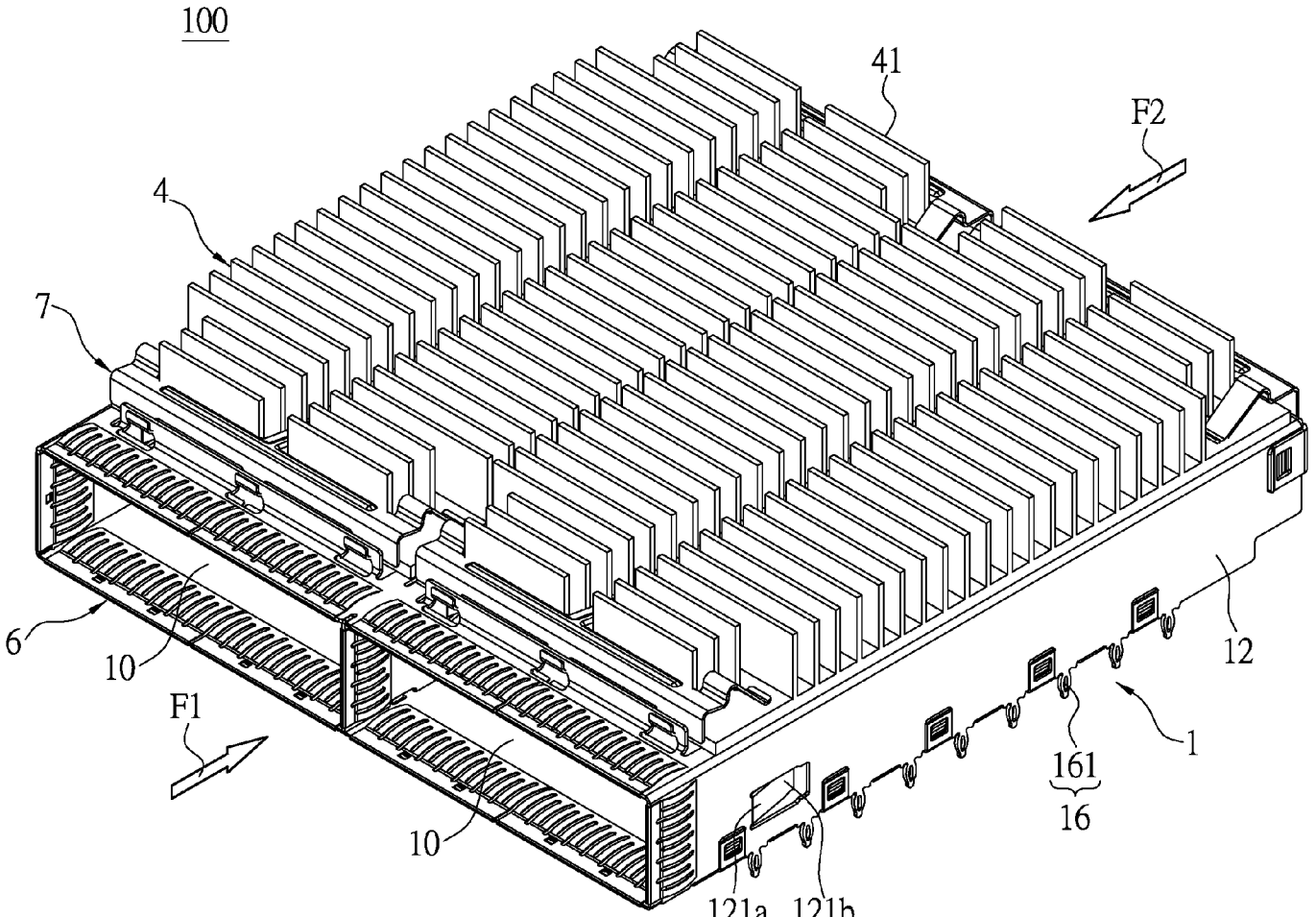
FIG. 3A is a perspective view illustrating a shielding jack of a connector module in accordance with the instant disclosure.

An embodiment is further elaborated herein. Please refer to FIGS. 1A, 1B and 3A. FIG. 1A is an exploded perspective view illustrating the shielding jack of the connector module. FIG. 1B is an exploded perspective view from a different viewing angle illustrating the shielding jack of the connector module. FIG. 3A is a perspective view illustrating the shielding jack of the connector module. As shown in FIGS. 1A and 1B, the shielding jack 1 is formed by stamping metal. The plurality of slots 10 which receives the connectors 2 is defined by the shielding jack 1. The shielding jack 1 has a top wall 11, a bottom wall 14, two side walls 12 and at least one common wall 13. As shown in FIG. 3A, the top, bottom, side and common walls 11, 14, 12, 13 collectively define a plurality of openings (not labeled) and the slots 10. The slots 10 receive the connectors 2 therein (FIG. 6). In addition, the top wall 11 of the shielding jack 1 is formed with a heat sink opening 111 for retaining a heat sink 4. The heat sink 4 has a plurality of fins 41 and is accommodated within the heat sink opening 111.

Figure 4:
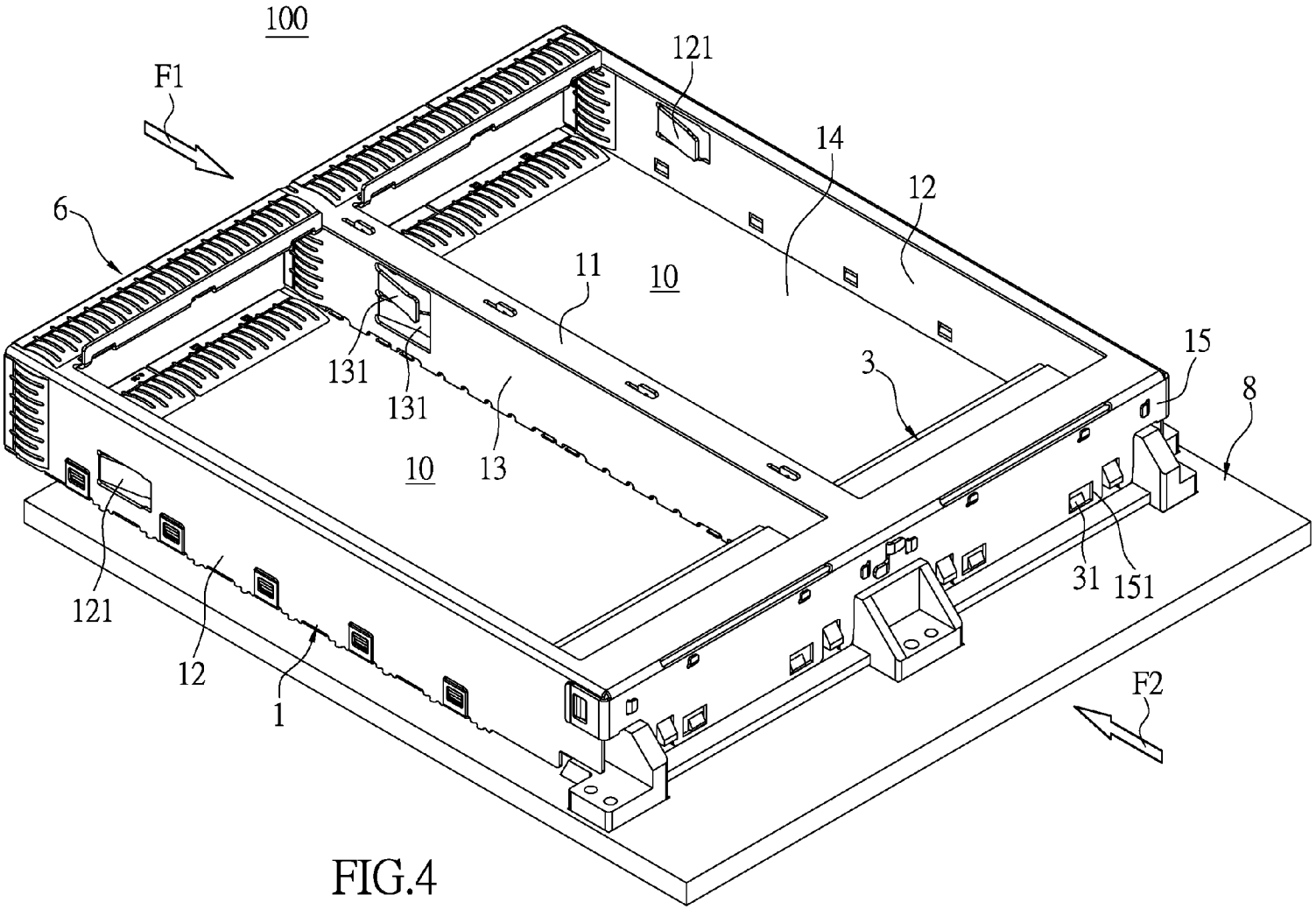
FIG. 4 is a perspective view illustrating a connector module omitting the pressing frame and the heat sink in accordance with the instant disclosure.

Please refer to FIGS. 1A, 2 and 6. FIG. 2 is a perspective view illustrating the common wall of the connector module. FIG. 6 is an operation view of the connector module. As shown in FIGS. 2 and 6, the common wall 13 of the shielding jack 1 has two offset latch arms 131. Specifically, the two latch arms 131 are formed by stamping and cutting. The latch arms 131 slantingly project toward the respective side walls 12 of the shielding jack 1 (FIG. 4). In the instant embodiment, as shown in FIG. 2, each latch arm 131 has a fixed end 131*a* connecting to the common wall 13 and a free end 131*b* slantingly extending to the rear end F2 from the fixed end 131*a*. As shown in FIG. 6 the connector 2 has two opposite walls 21 and each wall 21 is formed with a latch slot 211. When the connector 2 enters the corresponding slot 10, the free end 131*b* of the latch arm 131 mate with the latch slot 211 and therefore the connector 2 is secured in the slot 10. It is worth noting that, as shown in FIG. 2, the width of each latch arm 131 increases from the fixed end 131*a* to the free end 131*b*. As a result, the two latch arms 131 have the largest available contacting area to secure the connectors 2 in the slot 10. That is to say, the common wall 13 of the shielding jack 1 effectively utilizes available materials in a limited space. Therefore, the connectors 2 do not easily fall off when shaken so as to prevent signal transmission interruption. Furthermore, the latch arms 131 are formed on the same window (not labeled) of the common wall 13 and the free ends 131*b* of the two latch arms 131 are flush. When the connector 2 and the connector module 100 mate, the connector 2 slides along the common wall 13 until the latch slot 211 receives the tip of the free end 131*b* of the latch arm 131 to allow engagement therebetween. Then the connector 2 is secured in the slot 10 in a smooth and easily aligned manner. More specifically, in the instant embodiment, the two latch arms 131 have the largest available locking areas and the free ends 131*b* of the two latch arms 131 are flush such that the latch slots 211 of the connectors 2 can simply be formed at the same position on the walls 21.

Figure 3B:
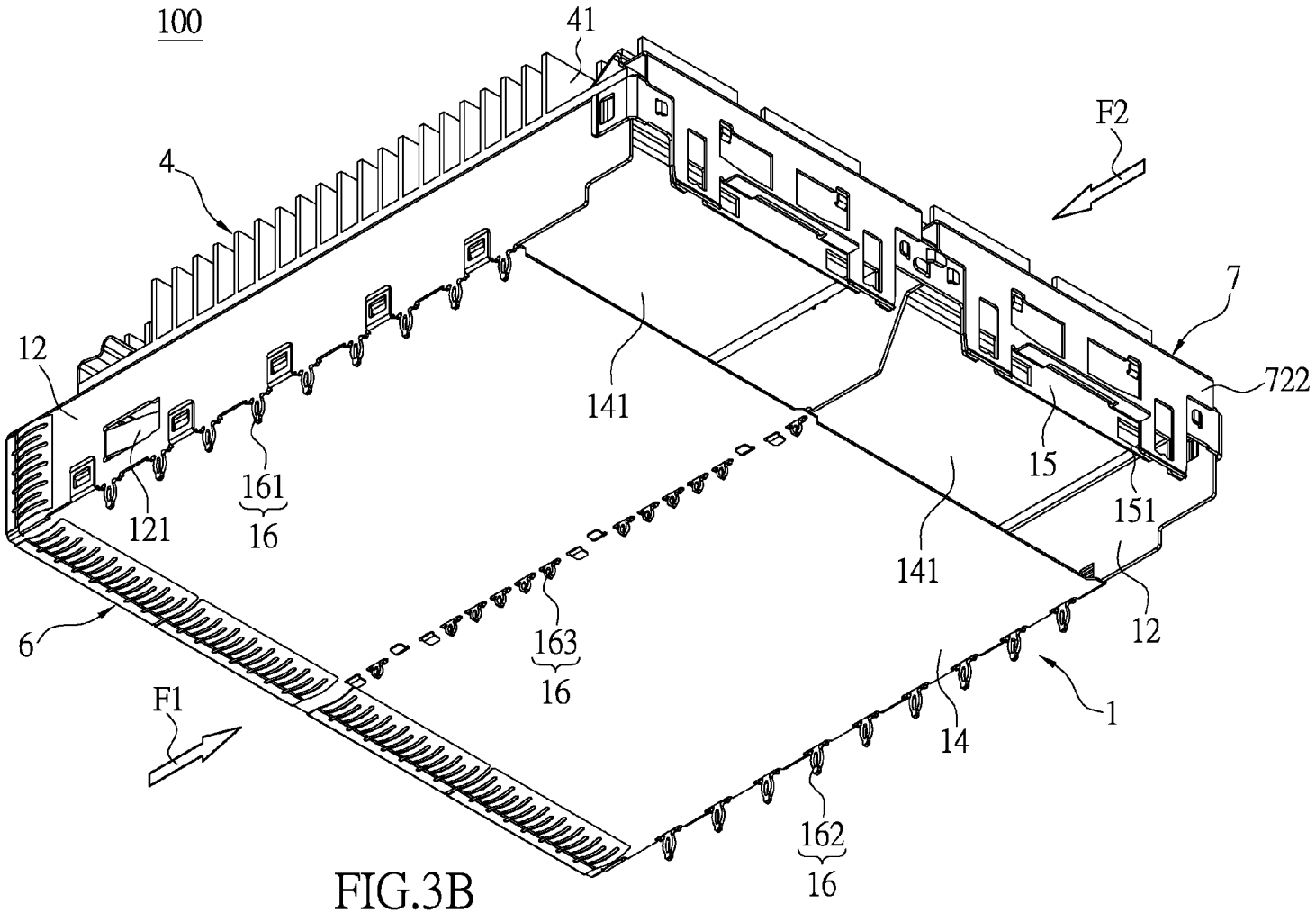
FIG. 3B is a perspective view from a different viewing angle illustrating a shielding jack of a connector module in accordance with the instant disclosure.
Figure 3C:
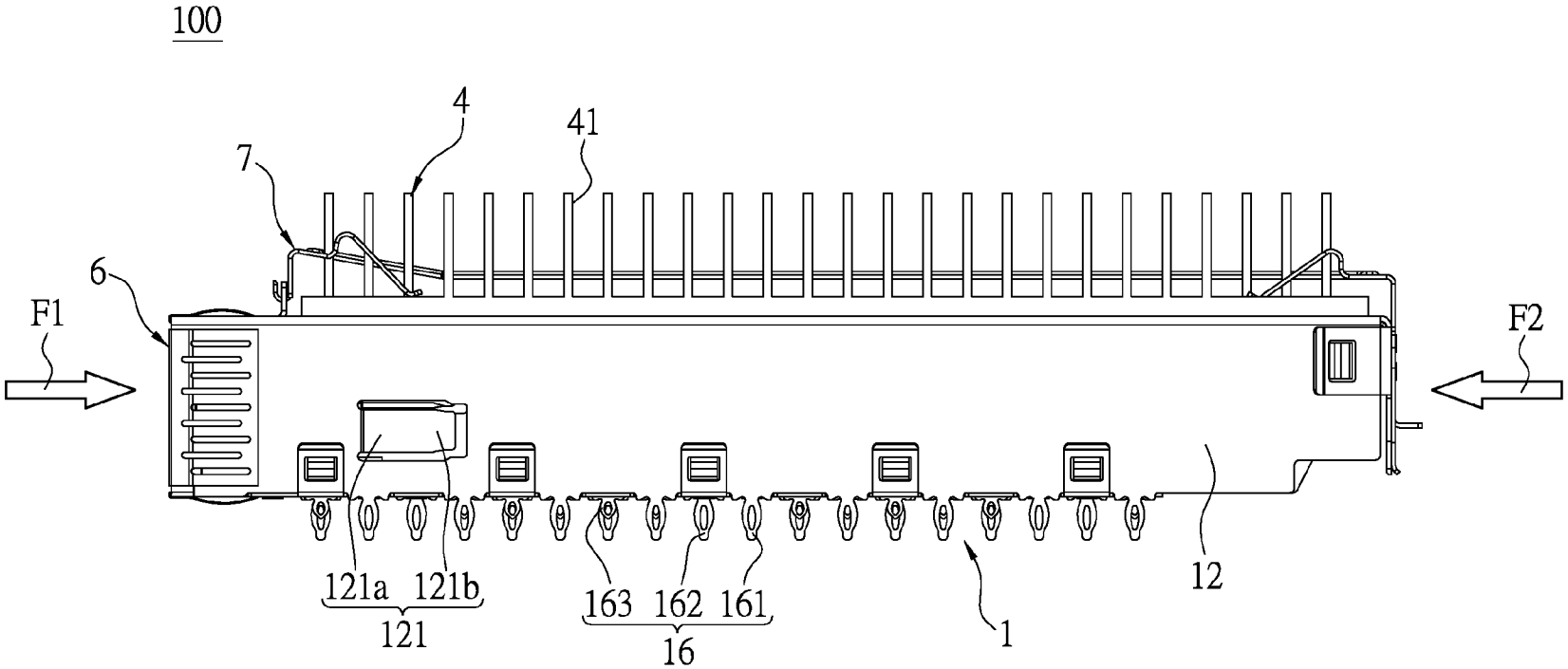
FIG. 3C is a side view illustrating a shielding jack of a connector module in accordance with the instant disclosure.

Referring to FIGS. 3C and 6, the opposite side walls 12 of the shield jack 1 are respectively formed with a positioning arm 121. The positioning arms 121 slantingly project toward the interior of the shielding jack 1. Preferably, each positioning arm 121 has a fixed end 121*a* connecting to the side wall 12 and a free end 121*b* slantingly extending from the fixed end 121*a* toward the rear end F2 of the shielding jack 1. As shown in FIG. 6, because the two walls 21 of the connector 2 is respectively formed with the latch slot 211, when the connector 2 mate with the slot 10, the free end 131*b* of the latch arm 131 is engaged with the latch slot 211 of one wall 21 while the free end 121*b* of the positioning arm 121 is engaged with the latch slot 211 of the other wall 21. The connector 2 is therefore firmly secured in the slot 10. It is worth noting that the positioning arm 121 has the largest available area and the width of the positioning arm 121 reduces from the fixed end 121*a* to the free end 121*b*. Also, the design of the positioning arms 121 maximizes the working area between the arms 121 and the slots 10 in the space-limited shielding jack 1, and therefore the connector 2 is tightly clamped in the slot 10.

Referring to FIGS. 1A and 2, the connector module 100 may further include a plurality of shielding sheets 6 at the front end F1 of the shielding jack 1. As shown in FIG. 1A, the shielding sheets 6 are engaged with the top wall 11, side walls 12, common wall 13 and bottom wall 14. As shown in FIG. 2, each shielding sheet 6 is integrally formed and has a bent portion 61 and two fastening portions 62 which extend from the bent portion 61 toward the rear end F2 of the shielding jack 1. In the instant embodiment, the shielding sheets 6 are metallic sheets serving to prevent EMI. The clamp portions 62 of each shielding sheet 6 each have a curved portion 621 and a planar portion 623 which extends from the curved portion 621 toward the rear end F2 of the shielding jack 1. The bent portion 61 and the planar portion 623 of each shielding sheet 6 clamp the shielding jack 1 such that the shielding sheets 6 are firmly fastened to the shielding jack 1. Specifically, the curved portions 621 of the shielding sheet 6 define a plurality of identical slits 622 in alternative arrangement. The slits 622 do not cut through the entire shielding sheet 6 such that when pulling out the connector 2 from the slot 10, the shielding sheets 6 remain attached to the shielding jack 1.

Please refer to FIG. 4. FIG. 4 is a perspective view illustrating the connector module without a pressing frame nor the heat sink. As shown in FIG. 4, the bottom wall 14 of the shielding jack 1 extends from the front end F1 to the rear end F2 of the shielding jack 1 yet the bottom wall 14 does not fully cover the entire length. However, the top wall 11 extends from the front end F1 to the rear end F2, covering the entire length. In other words, the arrangement of the top and bottom walls 11, 14 defines a bottom opening 141 (FIG. 3B) to receive at least one joint 3. Specifically, the rear wall 15 of the shielding jack 1 is formed with a plurality of grooves 151. The joints 3 have a plurality of latches 31 in conformity with the grooves 151. The joints 3 are screwed to the printed circuit board 8 so as to enhance the engagement between the shielding jack 1 and the printed circuit board 8. The signal transmission between the connector 2 and the shielding jack 1 is further stabilized by the presence of the joint 3.

Figure 5:
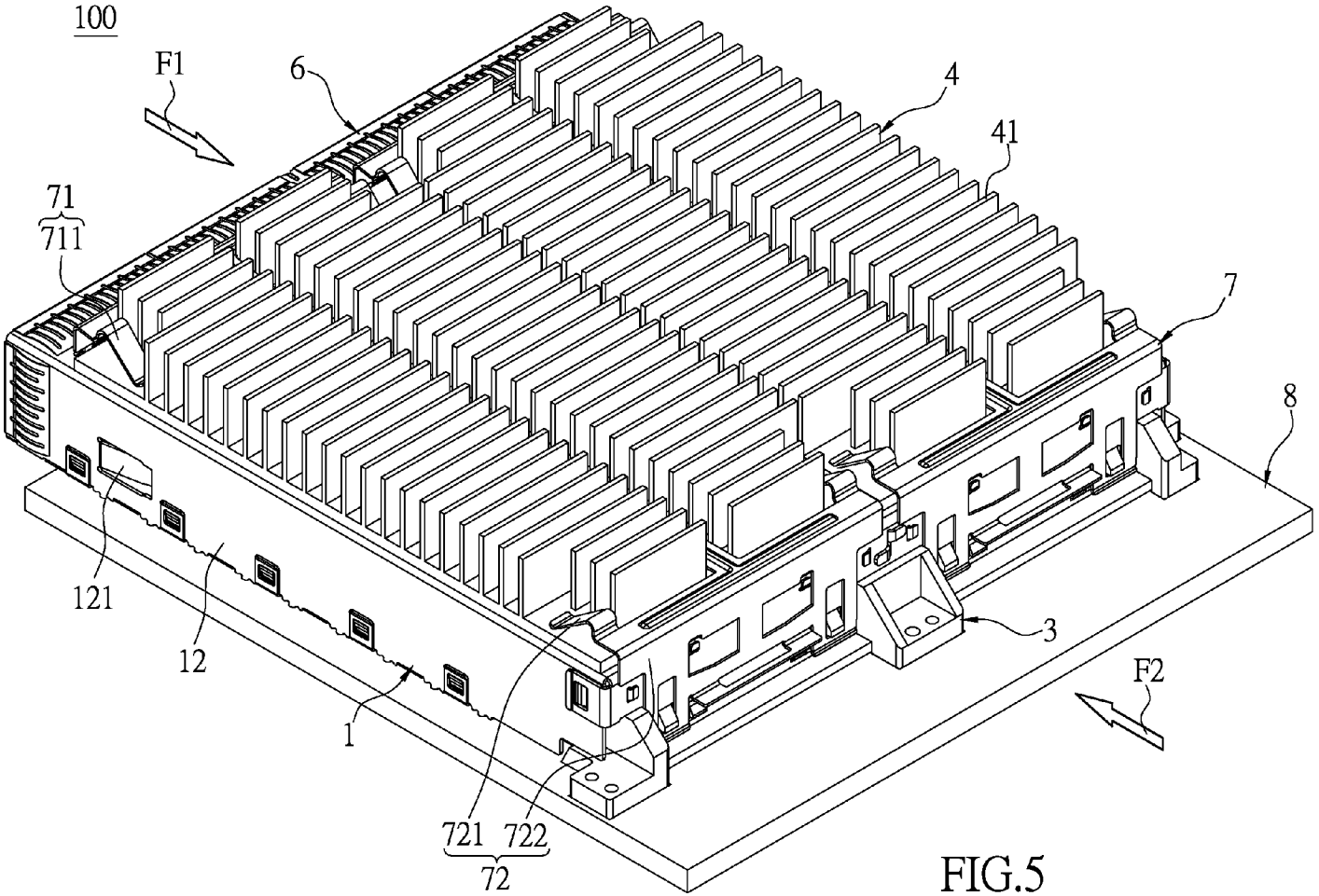
FIG. 5 is a perspective view of a connector module in accordance with the instant disclosure.

Please refer to FIG. 1 in conjunction with FIG. 5. FIG. 5 is a perspective view of the connector module. As shown in FIG. 1A, a pressing frame 7 is disposed on the top wall 11 of the shielding jack 1 to fasten the heat sink 4 in the heat sink opening 111. In the instant embodiment, the pressing frame 7 has a rib 73 and a front pressing portion 71 and a rear pressing portion 72 both extending from the rib 73. In general, the pressing frame 7 resembles the letter "I". More specifically, the two sides of the front pressing portion 71 respectively have a front pressing sheet 711. The two sides of the rear pressing portion 72 respectively have a rear pressing sheet 721. The front and rear pressing sheets 711, 721 respectively abut the corners of the heat sink 4 while the rib 73 abuts the middle region of the heat sink 4. As shown in FIG. 5, the rear pressing portion 72 may further extend to form an expansion 722. The expansion 722 is engaged with the corresponding joint 3 and the front pressing portion 71 is fastened to the front end F1 of the shielding jack 1. The heat sink 4 is firmly secured to the top of the slot 10 by the pressing frame 7. The ratio of the slot 10 to the pressing frame 7 is 1 to 1 and therefore the number of the slot 10 and pressing frame 7 may vary according to desired design.

Referring to FIG. 1B, the rear wall 15 of the shielding jack 1 may have at least two sets of protrusions 5. The protrusions 5 are on the same plane. Each protrusion 5 has two resilient sheets 51 which are face to face and extend toward the front end F1 of the shielding jack 1. As shown in FIG. 6, when the connector 2 is locked in the slot 10, the latch arms 131, positioning arms 121 and the resilient sheets 51 collectively confine the position of the connector 2. When the shield jack 1 encounters shocks, the connector 2 does not shift forward or backward because the resilient sheets 51 abut the connector 2 and absorb the shocks. In addition, when the connector 2 is about to be pulled out from 10, the resilient sheets 51 provide a pushing force to facilitate detachment. Furthermore, the resilient sheets 51 are densely arranged (two in the instant embodiment) at the rear wall 15 corresponding to one single slot 10 such that the resilient sheets 51 exert sufficient force to the connector 2.

Figure 7A:
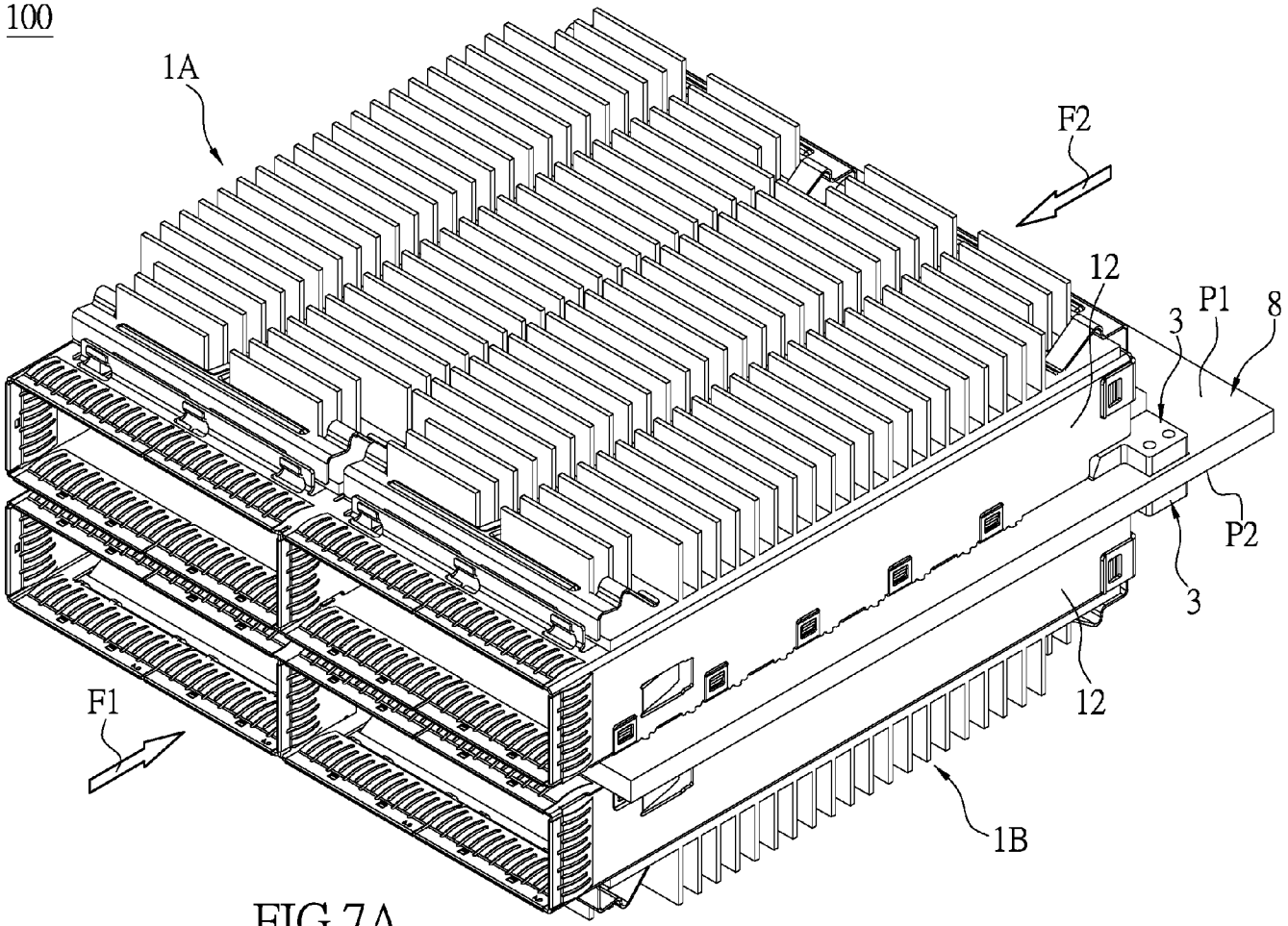
FIG. 7A is a perspective view illustrating a dual receiving alignment of a connector module in accordance with the instant disclosure.
Figure 7B:
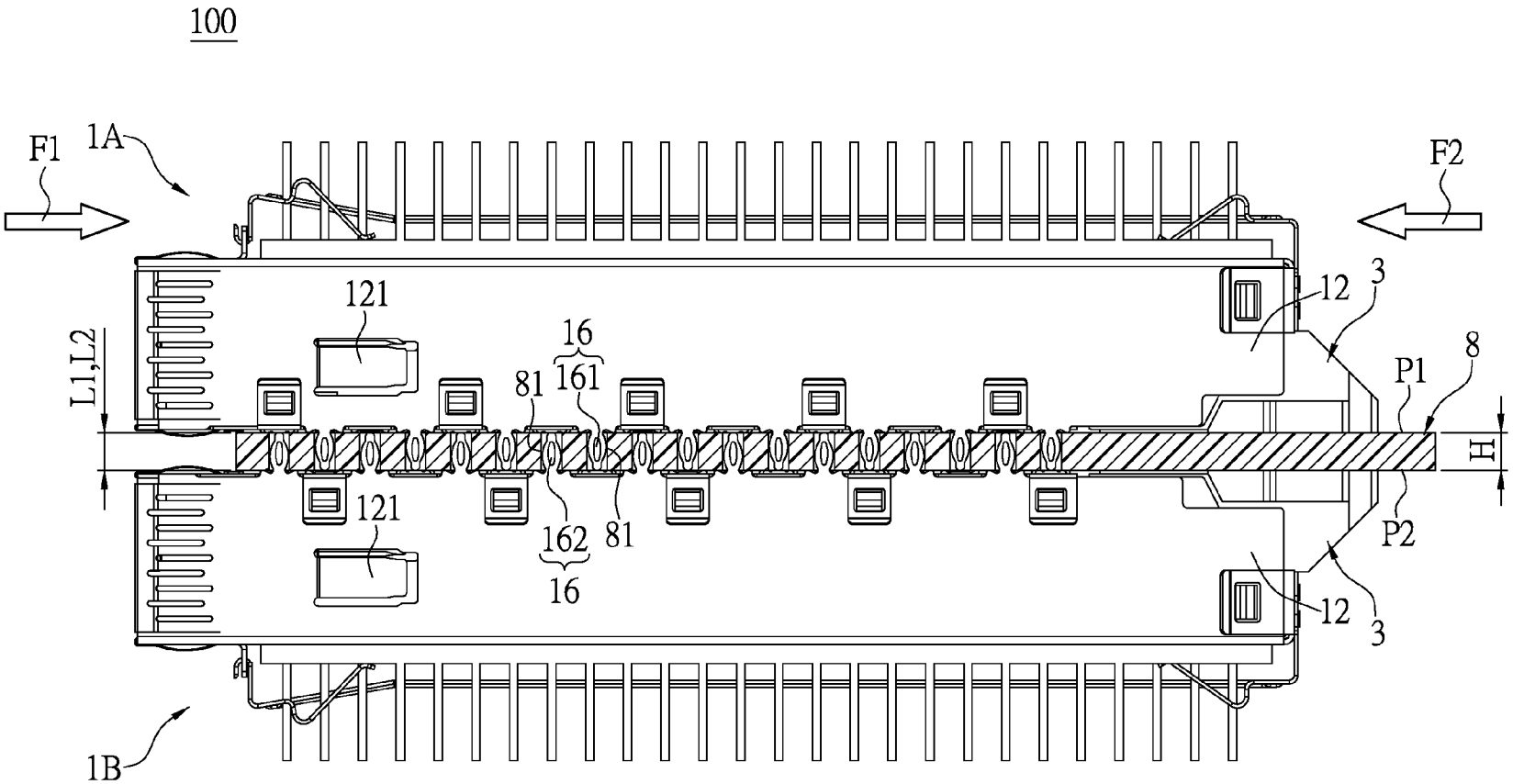
FIG. 7B is a side view illustrating a dual receiving alignment of a connector module in accordance with the instant disclosure.
Figure 7C:
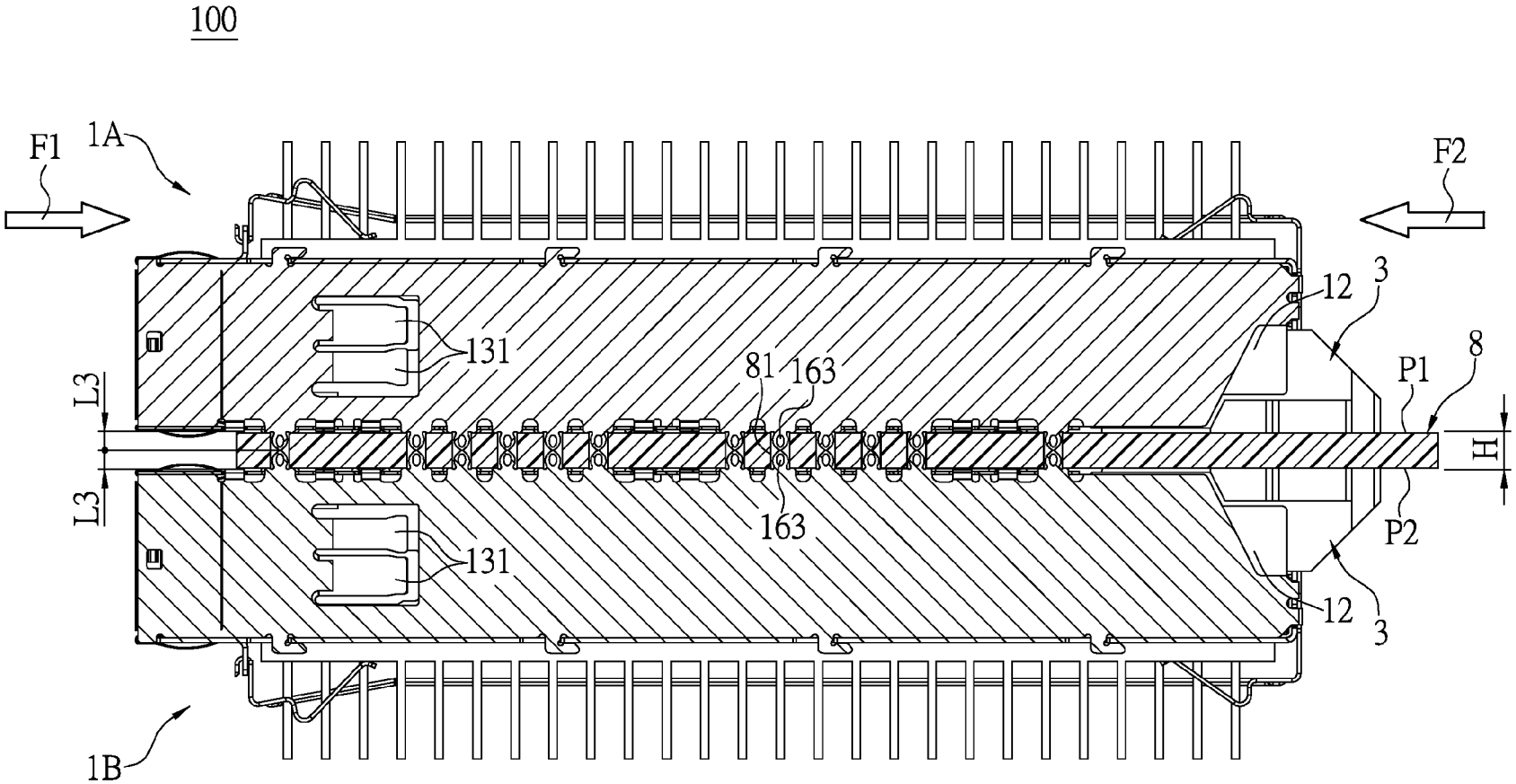
FIG. 7C is a cross-sectional view illustrating a side wall under dual receiving alignment of a connector module in accordance with the instant disclosure.

Please refer to FIGS. 3B, 3C, 7A to 7C. FIG. 7A is a perspective view illustrating a dual receiving alignment of the connector module. FIG. 7B is a side view illustrating the dual receiving alignment of the connector module. FIG. 7C is a cross-sectional view illustrating the side wall under dual receiving alignment of the connector module. As shown in FIGS. 3B and 3C, the side walls 12 of the shielding jack 1 are formed with a plurality of first press fit terminals 161 and a plurality of second press fit terminals 162, both directing toward the circuit board 8 (FIG. 5). The common wall 13 of the shielding jack 1 is formed with a plurality of third press fit terminals 163 toward the circuit board 8 (FIG. 5). The first and second press fit terminals 161, 162 are arranged alternately. As shown in FIG. 7A, the circuit board 8 has a top face P1 and an opposite bottom face P2 and a plurality of through apertures 81 (FIG. 7B) to receive the press fit terminals 16 (FIG. 3B). The apertures 81 have substantially the same depth H. In the instant embodiment, the shielding jacks 1A and 1B are respectively disposed on the top and bottom faces P1, P2 of the circuit board 8 (dual receiving). As shown in FIG. 7B, the first press fit terminals 161 of the shielding jack 1A and the second press fit terminals 162 of the shielding jack 1B are alternatively arranged. Likewise, the first press fit terminals 161 of the shielding jack 1B and the second press fit terminals 162 of the shielding jack 1A are alternatively arranged. Therefore, the first press fit terminals 161 of the shielding jack 1A and the second press fit terminals 162 of the shielding jack 1B are inserted to different apertures 81 aligning along the same axis. The length L1 of the first press fit terminals 161 and the length L2 of the second press fit terminals 162 are taller than half of the aperture depth H. In the instant embodiment, the length L1 is equal to the length L2.

The length of the third press fit terminals 163 of the shielding jack 1A and the third press fit terminals 163 of the shielding jack 1B is denoted as L3. It is worth nothing that as shown in FIG. 7C, the length L3 is shorter than half of the aperture depth H. When the shielding jacks 1A and 1B are respectively disposed on the top and bottom faces P1, P2 of the printed circuit board 8 (dual receiving), the third press fit terminals 163 of the shielding jacks 1A and 1B go through the same apertures 81 on one axis. Hence, the number of apertures 81 on the printed circuit board 8 can be limited to a minimum.

It should be understood that the abovementioned orientations are in reference with the diagram and the instant disclosure is not limited thereto.

In summary, the width of the latch arms formed on the common wall gradually increases from the fixed end to the free end and the latching area is therefore maximized in a restricted space. The width of the positioning arms formed on the side walls gradually reduces from the fixed end to the free end and the force created by the positioning arms to the connector is maximized. The shielding sheets are spaced and configured to identical dimension in alternative arrangement. The alternate arrangement creates the plurality of continuous slits to prevent the shielding sheet from being withdrawn when pulling the connector. The bottom wall of the shielding jack is arranged to allow a bottom opening for receiving the joint. The joint is fastened on the printed circuit board by screws and engaged with the rear wall of the shielding jack. Therefore the shielding jack is steadily attached to the printed circuit board. The protrusions formed on the rear wall are capable of shock absorbing and proving a pushing force to the connector. The protrusions are densely arranged on the rear wall to generate a stronger force. The alternative arrangement of the first and second press fit terminals and the shorter-than-half-the-aperture-depth length of the third press fit portion of the common wall can effectively reduce the aperture number required on the printed circuit board.

The descriptions illustrated supra set forth simply the preferred embodiments of the instant disclosure; however, the characteristics of the instant disclosure are by no means restricted thereto. All changes, alternations, or modifications conveniently considered by those skilled in the art are deemed to be encompassed within the scope of the instant disclosure delineated by the following claims.

What is claimed is:

1. An electrical connector module for electrically connecting a plurality of connectors to a printed circuit board of an electronic device, the electrical connector module comprising:

at least one shielding jack including a top wall, two opposite side walls, a bottom wall and at least one common wall, wherein the shielding jack defining a front end, an opposite rear end and a plurality of slots each receiving a corresponding connector and divided by the common wall, wherein the side walls and the common wall having a plurality of press fit terminals extending to the circuit board, and wherein the common wall having a plurality of offset latch arms each engaged with the corresponding connector; and a plurality of joints each received by at least one bottom opening configured to the bottom wall;

wherein when the connectors are inserted to the slots, each of the offset latch arms respectively secure the corresponding connector in the corresponding slot;

wherein the shielding jack includes a rear wall formed with a plurality of grooves, each joint has a plurality of latches received by the plurality of grooves, is fastened to the circuit board and abuts the rear wall of the shielding jack.

2. The electrical connector module according to claim 1, wherein the common wall is formed with two of the offset latch arms, the latch arms are respectively projected toward two opposite side walls of the common wall.

3. The electrical connector module according to claim 2, wherein each of the latch arms has a fixed end and a free end, the fixed end connects to the common wall and the free end slantingly extends from the fixed end toward the rear end of the shielding jack, a width of each of the latch arms increases from the fixed end to the free end, and tips of each pair of the latch arms are flushed.

4. The electrical connector module according to claim 3, wherein each of the two side walls has a positioning arm slantingly projecting toward an interior of the shielding jack.

5. The electrical connector module according to claim 4, wherein the positioning arm has a fixed end and a free end, the fixed end connects to the side wall and the free end slantingly extends from the fixed end toward the rear end of the shielding jack, and a width of positioning arm reduces from the fixed end to the free end.

6. The electrical connector module according to claim 5, wherein the connector has two walls, each of the walls is formed with a latch slot, the free end of the latch arm is received by one of the latch slot and the positioning arm is received by the other latch slot.

7. The electrical connector module according to claim 1 further comprising a plurality of shielding sheets engaged with the shielding jack, the shielding sheets are integrally formed with a plurality of slits.

8. The electrical connector module according to claim 7, wherein each of the shielding sheets has a bent portion and two clamp portions extending from the bent portion toward the rear end of the shielding jack, and the bent portion clamps the shielding jack.

9. The electrical connector module according to claim 8, wherein each of the clamp portions has a curved portion and a planar portion extending from the curved portion toward the rear end of the shielding jack, the curved portions are evenly spaced by the plurality of the equal-length, alternately arranged slits, and the planar portions of the clamp portions clamp the shielding jack.

10. The electrical connector module according to claim 1, wherein the rear wall has at least two sets of protrusions correspondingly positioned to the slot, each set of the protrusions is coplanar and has two resilient sheets which face each other and extend toward the front end of the shielding jack.

11. An electrical connector module for electrically connecting a plurality of connectors to a printed circuit board of an electronic device, the electrical connector module comprising:

at least one shielding jack including a top wall, two opposite side walls, a bottom wall and at least one common wall, wherein the shielding jack defining a front end, an opposite rear end and a plurality of slots each receiving a corresponding connector and divided by the common wall, wherein the side walls and the common wall having a plurality of press fit terminals extending to the circuit board, and wherein the common wall having a plurality of offset latch arms each engaged with the corresponding connector;

a plurality of joints each received by at least one bottom opening configured to the bottom wall;

a heat sink having a plurality of fins, wherein the top wall of the shielding jack is formed with a heat sink opening for receiving the heat sink; and a pressing frame having a rib, a front pressing portion and a rear pressing portion extending from two ends of the rib, wherein when the corresponding connector is inserted to the corresponding slot, each of the offset latch arms respectively secure the corresponding connector in the corresponding slot;

wherein two sides of the front pressing portion are respectively formed with front pressing sheets, two sides of the rear pressing portion are respectively formed with rear pressing sheet, the front and rear pressing sheets abut corners of the heat sink and the rib abuts a middle portion of the heat sink.

12. The electrical connector module according to claim 11, wherein the rear pressing portion further expands to form an expansion, the expansion is engaged with one of the joints correspondingly, and the front pressing portion is engaged with the front end of the shielding jack.

13. The electrical connector module according to claim 11, wherein the press fit terminals have a plurality of first press fit terminals, a plurality of second press fit terminals, which are formed on the side walls and directed toward the printed circuit board in an alternate arrangement, and a plurality of third press fit terminals, which is formed on the common wall and directed toward the printed circuit board.

14. The electrical connector module according to claim 13, wherein the printed circuit board is formed with a plurality of apertures having identical depth, the length of the first and second press fit terminals is taller than half of the aperture depth while the length of the third press fit terminals is shorter than half of the aperture depth.

15. The electrical connector module according to claim 14, wherein the printed circuit board has a top face and an opposite bottom face, two shielding jacks are respectively disposed on the top and bottom faces, the first press fit terminals of one of the two shielding jacks and the second press fit terminals of the other one of the two shielding jacks go through different apertures on the same axis in alternate fashion, and the third press fit terminals of one of the two shielding jacks and the third press fit terminals of the other one of the two shielding jacks go through the same apertures on the same axis.

* * * * *